United States Patent [19]

Neidl

[11] 3,972,483

[45] Aug. 3, 1976

[54] PUMPING AND PULVERIZING APPARATUS

[76] Inventor: Georg Neidl, Furst Johannes Strasse, Schaan, Liechtenstein

[22] Filed: Mar. 17, 1975

[21] Appl. No.: 558,919

[52] U.S. Cl. ..... 241/46.11; 241/185 A

[51] Int. Cl.² ..... B02C 23/36

[58] Field of Search ..... 241/46.11, 46.17, 185 D; 415/70, 121 B; 416/238

[56] References Cited

UNITED STATES PATENTS

| | | | |
|---|---|---|---|
| 736,137 | 8/1903 | McIntosh | 416/238 X |
| 958,599 | 5/1910 | Cooksey | 416/238 |
| 3,005,597 | 10/1961 | Neidl | 241/185 A |
| 3,375,983 | 4/1968 | Von Eiff et al. | 241/46.11 |
| 3,722,804 | 3/1973 | Petersen | 241/46.11 |
| 3,738,582 | 6/1973 | Neidl | 241/46.11 |

FOREIGN PATENTS OR APPLICATIONS

| | | | |
|---|---|---|---|
| 1,172,121 | 6/1964 | Germany | 415/121 B |

*Primary Examiner*—Granville Y. Custer, Jr.
*Attorney, Agent, or Firm*—Fisher, Christen & Sabol

[57] ABSTRACT

Pumping and pulverizing apparatus for liquids containing solid materials includes a housing defined by a cylinder of revolution having an inlet opening at one end in alignment with the axis with a rotor mounted at the opposite end of the housing on a shaft which also rotates on an axis concentric with the axis of the housing; the rotor has at least two inclined surfaces which lie close to each other at their locus of attachment to the shaft and diverge in the direction of the inlet, which tends to avoid entanglement of the pumped materials with the shaft.

17 Claims, 8 Drawing Figures

PUMPING AND PULVERIZING APPARATUS

Figure 1:
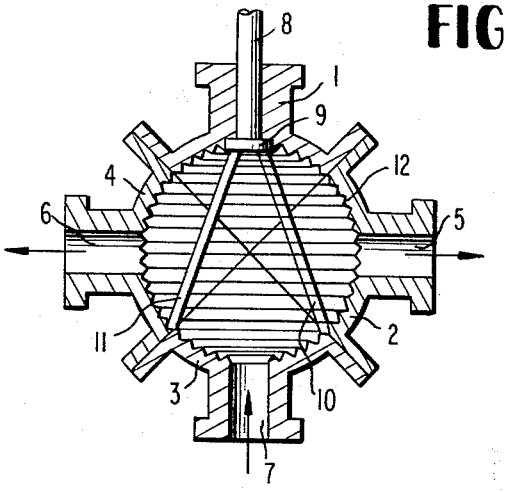

This invention relates to pumping and pulverizing apparatus for use in conveying liquids containing large proportions of pulpy and/or semi-solid materials.

Various types of pumping apparatus useful for this purpose are known, in which a single inclined disc extends transversely across the entire width of a housing, and is mounted on a shaft for rotation within the housing. In these pumps, the shaft extends into the housing and the disc is attached thereto at a medial location along the length of the shaft.

It is also known to mount two semi-circular discs, facing in oppositely inclined directions, on the shaft, but in this case also, the locus of the connection between the disc sections and the shaft is approximately in the center of the housing.

The prior pumps are quite effective in operation but they have the disadvantage that, of necessity, the shaft extends through the center of the housing and tends to impede the flow of material and create unnecessary turbulence.

Therefore, it is an object of the present invention to improve the operating efficiency of pumping apparatus of the inclined rotor type.

One method by which the objects of the invention are accomplished is by mounting the rotor shaft for rotation about an axis in alignment with the inlet opening into the housing, in contradistinction to the prior designs in which the inlet is placed in a transverse plane.

A further feature of the invention consists in the provision of a rotor having a shape such that it may be secured to the driving shaft at a location adjacent the wall of the housing opposite from the inlet opening, whereby the shaft does not protrude into the housing to obstruct the flow of materials.

In one form of the invention, it may consist of a rotor having two blades defined by a curved surface which diverges outwardly and away from the locus of attachment to the shaft and extends across the entire width of the housing.

In a modification of the invention, the rotor may comprise at least one pair of partial discs disposed on opposite sides of a plane passing through the axis of rotation, the discs being attached to the shaft at the point where it enters the housing; the respective discs extending away from the locus of attachment in divergent directions. It is also contemplated that more than one pair of blades may be included, the respective pairs diverging away from the axis at different angles.

In all cases however, in the present invention, the surface, or surfaces, of the rotor blade, or blades diverge away from each other in a direction which faces the inlet opening, and the blade, or blades, at their convergent end are attached to the driving shaft adjacent the area of the housing opposite to the inlet opening.

In a further modification, the housing may be defined by a surface of revolution having its axis concentric with that of the driving shaft, and the inlet opening may have a diameter equal to the effective radial area of the blade, or blades.

The surfaces of the blades may be flat, or curved, and in the latter case, the surfaces may be defined, for example, in cross-section, by a parabola, with the blade being attached to the shaft in the area where the curvature of the surface approaches tangency with a plane normal to the rotational axis.

Pumping apparatus according to the invention can be used in operations where the pump is either dipped into the liquid to be pumped, or else mounted in a stationary location. While only a single outlet connection is necessary, two or more outlets in the housing can be provided. The inside surface of the housing and the coacting margins of the blades may be smooth, or the margins may be serrated, with cooperating annular serrations in the housing surface, as is well known.

Figure 1A:
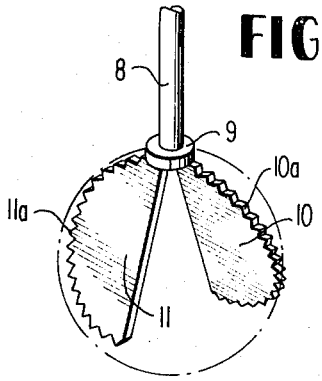
Figure 2:
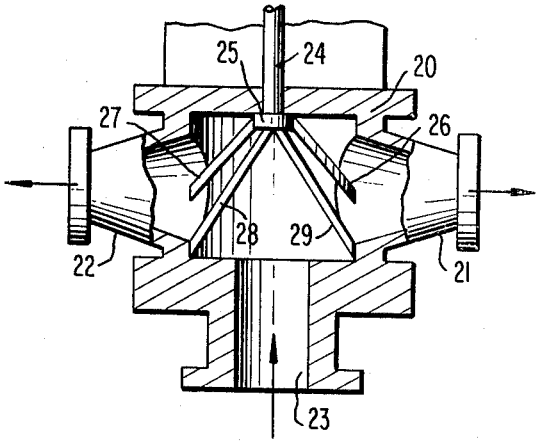
Figure 2A:
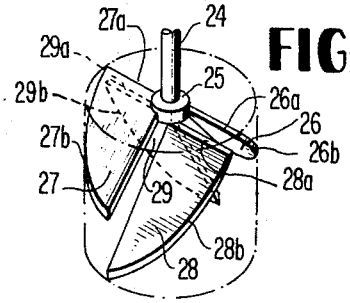
Figure 3:
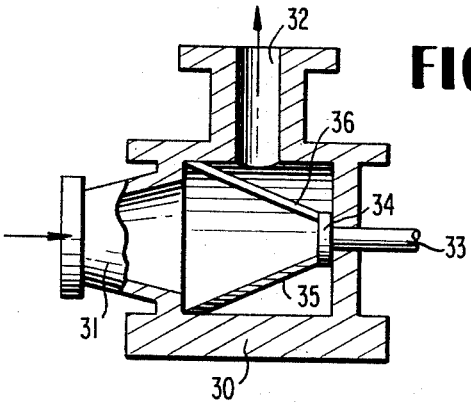
Figure 3A:
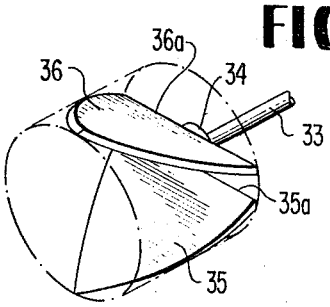
Figure 4A:
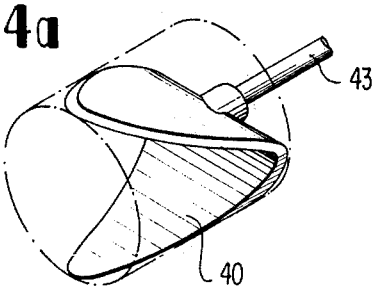
Figure 4:
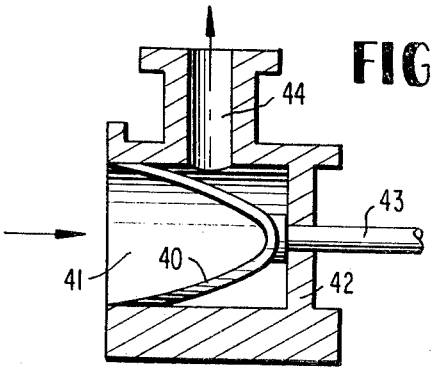

In the drawings,

FIG. 1 is a cross-section of a preferred embodiment of the invention in which the housing is spherical;

FIG. 1*a* is a perspective view of the rotor of FIG. 1;

FIGS. 2 and 2*a* are, respectively, a cross-section of a modified form of the invention and a perspective of the modified rotor;

FIGS. 3 and 3*a* are, respectively, a cross-section of another modification, and a perspective of its rotor, and;

FIGS. 4 and 4*a* are, respectively, a cross-section of a third modification and a perspective view of the rotor used therein.

In the preferred embodiment shown in FIGS. 1 and 1*a*, it will be seen that the housing comprises four semi-spherical quadrants 1, 2, 3 and 4, having exterior flanged, connecting portions and provided with a pair of diametrically opposed outlet openings 5 and 6 and an inlet opening 7 arranged in alignment with the axis of a driving shaft 8 having a hub 9 which lies adjacent the inner surface of the housing opposite the inlet opening. This hub supports a rotor which, in this embodiment, consists of two partial discs 10 and 11 which diverge outwardly from each in the direction of the inlet opening with their extremities disposed on opposite sides of this opening. Each disc is disposed on opposite sides of a plane extending through the axis of the shaft and at least one portion of the margins 10*a* and 11*a* of each disc extending between the locus of attachment to the shaft, at hub 9, and their respective extremities, conforms to the inner surface of the housing. The two partial discs are attached to the hub as close together as possible so that a minimum amount of the driving shaft is exposed to the interior of the housing. It is also contemplated that a single disc could be used in which the surface curves towards a plane normal to the shaft axis at the point of attachment thereto to minimize exposure of the shaft.

As in the case of FIGS. 1 and 1*a*, the embodiment of FIGS. 2 and 2*a* can be arranged to draw liquid through an inlet at the bottom of the housing.

In this modification, the housing 20 is cylindrical, having two outlet openings 21 and 22 facing each other in the cylindrical wall and an inlet opening 23 in the center of one end wall. Opposite the inlet, and in axial alignment, there is a driving shaft 24, having a hub 25 adjacent the inner surface of the opposite end wall. This hub supports a first pair of symmetrical blades 26 and 27, diverging away from each other at an obtuse angle, while another pair of similar symmetrical blades 28 and 29 are supported by the hub at an acute divergent angle.

In this modification, the interior wall of the housing is smooth, and the coacting margins of the blades are also smooth. It should also be noted that, because the end wall of the housing adjacent the hub 25 is flat, each of the margins 26*a*, 27*a*, 28*a* and 29*a* of the blades will be defined by a straight line, whereas the outer margins 26*b*, 27*b*, 28*b* and 29*b* will follow curves defined by the intersections of the blade surfaces with the cylindrical wall of the housing.

Another embodiment of the invention is shown in FIGS. 3 and 3*a* in which the housing is stationary and the inlet 31 is horizontally disposed in the center of one end wall of a horizontally mounted cylindrical housing 30, with only a single outlet 32 arranged in the cylindrical wall. Opposite the inlet opening, and in axial alignment, there is a driving shaft 33, provided with a hub 34 adjacent the inner surface of the other end wall of the housing. The rotor consists of two flat partial discs attached to the hub 34 and diverging away from each other in the direction of the inlet, and the margins 35*a* and 36*a* adjacent the hub are defined by lines extending across the width of the housing corresponding to the configuration of the adjacent end wall.

Still another embodiment is shown in FIGS. 4 and 4*a*, which is a variation of the previous modification, in which the two blades 34 and 35 are replaced by a rotor in which a single curved surface 40 is folded back to define two divergent blades extending in the direction of the inlet opening 41. The cross-section shown in FIG. 4 happens to be parabolic, but other curvatures may be used which provide that a section at the locus of attachment to the end of shaft 43 is generally perpendicular in order to facilitate connection to the shaft and to shield the shaft from contact with materials being pumped.

In the modification of FIG. 4, it may also be observed that the cross-section of the inlet 41 corresponds to the cross-section of the inside of housing 42. This arrangement can also be used with the previous forms of the invention. In this case, the outlet opening 44 and the rotational axis of shaft 43. By using a large inlet, a maximum inlet velocity will be obtained.

The apparatus described above is capable of handling all types of liquids, including those having high viscosity as well as those containing solids of lumpy or pasty consistency, in which, pulverizing or crushing will take place in addition to pumping.

In should also be observed that in all of the modifications, the inner walls of the housing may be provided with annular serrations and that corresponding serrations can be provided in the margins of the rotors which may mesh with the serrations in the housing, although this is not essential.

What is claimed is:

1. In pumping and pulverizing apparatus, the combination comprising a housing having an interior wall defined by a surface of revolution, an inlet opening in said interior wall of the housing concentric with the axis of said surface of revolution, a rotor mounted on a drive shaft for rotation concentric with said axis, at least one outlet opening in the housing for discharging material, said rotor including at least two blades having symmetrical surfaces disposed on opposite sides of a plane passing through said axis and diverging outwardly towards said inlet from a common locus of attachment to said drive shaft with their respective extremities intersecting the wall of the housing on opposite sides of the inlet opening and between said inlet and outlet openings, said locus of attachment being adjacent the housing wall opposite the inlet opening said shaft entering the housing through said wall opposite the inlet and terminating at said locus of attachment, at least one portion of the margin of each blade extending between said locus and the respective extremity of that blade having an outline conforming to the adjacent interior wall of the housing.

2. The invention defined in claim 1, wherein at least the portions of said blades adjacent said locus of attachment are curved surfaces, the concavities of the surfaces facing toward said plane passing through the axis of revolution.

3. The invention defined in claim 2, wherein the entire margins of both blades extending away from said locus have outlines conforming to the adjacent interior wall of the housing.

4. The invention defined in claim 3, wherein the cross-section of the surfaces of said blades are defined by a parabola.

5. The invention defined in claim 1, wherein said surface of revolution is a sphere.

6. The invention defined in claim 5, wherein the interior surface of the housing is provided with annular serrations, the margins of the blades being provided with complementary serrations.

7. The invention defined in claim 5, wherein said housing is subdivided into four equal quadrants, each quadrant being provided with external flanges for joining the quadrants together.

8. The invention defined in claim 1, wherein said surface of revolution is a cylinder.

9. The invention defined in claim 8, wherein the interior surface of the housing is provided with annular serrations, the margins of the blades being provided with complementary serrations.

10. The invention defined in claim 8, wherein said inlet opening is generally coextensive in diameter with the inner diameter of the housing.

11. The invention defined in claim 8, wherein each of said blades is defined by a surface intersecting a plane passing through the axis of revolution of the housing and the inner wall of the housing.

12. The invention defined in claim 11, wherein the intersection of each blade with said plane is defined by a curved line which approaches tangency with a plane normal to the axis of revolution as it approaches said locus.

13. The invention defined in claim 12, wherein said curved line resembles a parabola.

14. The invention defined in claim 11, wherein intersection of each blade with said plane is defined by a straight line, said drive shaft including a hub, said blades being secured to said hub radially spaced from each other.

15. The invention defined in claim 11, wherein said rotor includes an even number of blades, one-half of the blades being disposed on one side of said plane, the remaining one-half being disposed on the opposite side.

16. The invention defined in claim 11, wherein said rotor includes at least two pairs of blades, one pair of blades subtending between them an angle which is greater than the angle subtended between the other of said two pairs of blades.

17. The invention defined in claim 16, wherein one blade of each of said two pairs of blades is disposed on one side of a plane passing through said axis of revolution, the other blade of each said pair being disposed on the opposite side of said plane.

* * * * *